US006138578A

United States Patent [19]

Cowan, Jr. et al.

[11] Patent Number: 6,138,578

[45] Date of Patent: Oct. 31, 2000

[54] FREIGHT CONTAINER VENTILATION SYSTEM

[75] Inventors: James A. Cowan, Jr., Barrington; Michael D. Gaikowski, Homewood, both of Ill.; John K. Deveikis, Marietta, Ga.; Richard J. Kloster, Schaumburg, Ill.

[73] Assignee: General Electric Railcar Services Corporation, Chicago, Ill.

[21] Appl. No.: 09/024,810

[22] Filed: Feb. 17, 1998

[51] Int. Cl.[7] ..... B61D 11/00; B61D 3/00

[52] U.S. Cl. ..... 105/355; 105/238.1; 105/357; 105/423

[58] Field of Search ..... 105/238.1, 355, 105/357, 396, 404, 409, 423; 410/121, 143, 153, 154

[56] References Cited

U.S. PATENT DOCUMENTS

| | | | |
|---|---|---|---|
| 515,608 | 2/1894 | Pancoast . | |
| 528,231 | 10/1894 | Love . | |
| 1,957,450 | 5/1934 | Fitch | 98/6 |
| 2,034,723 | 3/1936 | Fitch | 98/87 |
| 2,338,363 | 1/1944 | Strobell | 98/6 |
| 2,381,796 | 8/1945 | Williams | 105/357 |
| 2,585,666 | 2/1952 | McDowell | 98/40 |
| 4,481,870 | 11/1984 | Smith | 98/6 |
| 4,884,496 | 12/1989 | Donavich | 98/6 |
| 4,951,479 | 8/1990 | Araquistain et al. | 105/355 |
| 5,660,057 | 8/1997 | Tyree, Jr. | 62/384 |

*Primary Examiner*—S. Joseph Morano
*Assistant Examiner*—Robert J. McCarry, Jr.
*Attorney, Agent, or Firm*—Daniel J. Chalker; Ed Jorgenson; Gardere & Wynne, LLP

[57] ABSTRACT

A ventilated transportable freight container is disclosed. The container is ventilated by natural convection through at least one lower side vent comprising a lower plenum chamber for distributing air into the container and restricting entry of moisture in the form of rain, sleet or snow into the container and at least one upper top vent, including a plenum chamber. The upper top vent or vents may be formed in the sidewall of the enclosure or in the roof of the enclosure depending upon the structure of the container and the particular application. The use of one or more upper top vents enhances circulation of air by natural convection. The invention also incorporates sidewall and endwall spacers extending from the sidewalls and endwalls into the enclosure to provide passageways for the circulation of air to ventilate the enclosure and a path for condensation drainage. In one embodiment of the invention, the transportable freight container of present invention comprises a rail freight car. In another embodiment of the invention, at least one of the lower plenum chambers of the container extends lower than the floor of the enclosure to allow drainage from the enclosure. The container may also incorporate a layer of insulating material on the interior surface of the roof of the container to inhibit condensation of moisture. The freight container of the present invention is particularly adapted to the transport of baled material, such as pulp, which is typically shipped or transported in bales of approximately one cubic yard.

43 Claims, 4 Drawing Sheets

FREIGHT CONTAINER VENTILATION SYSTEM

TECHNICAL FIELD OF THE INVENTION

The present invention relates to containers utilized to transport materials and more particularly, to containers used in the transport of materials typically packaged as moist bales or bundles. More specifically, the invention relates to a railcar including means for venting the interior of the car around the bales or bundles of product while simultaneously preventing moisture, in the form of rain or snow, from entering the railcar. The invention further relates to positioning bales or bundles of product in the interior of a railcar without contact with the exterior walls to facilitate the flow of air through the railcar and the drainage of condensation from the car.

BACKGROUND OF THE INVENTION

Railcars, in particular freight railcars, are widely used to transport a wide variety of goods across a transportation network extending across most continents. A vast variety of goods are transported by rail, ranging from automobiles to produce. In many cases, materials transported by rail are typically packaged as bales, bundles or boxes.

The transportation of baled materials, such as wood pulp, in freight containers, such as a railcars, presents a number of potential problems. The interior of the container must be adequately ventilated to allow for the escape of water vapor released by the baled product. The interior of the container should include means for venting the interior of the car around the bales or bundles of product while simultaneously preventing moisture, in the form of rain, sleet or snow, from entering the container. The bales or bundles of product should be positioned and restrained within the container in a manner such that the cargo is not in direct contact with the interior of the container to facilitate ventilation of the container and to prevent the product from bleeding moisture onto the walls of the container. The container should also be provided with means to expedite the drainage of condensation from the car.

Thus, there exists a need for an improved freight container, adapted to overcome the foregoing drawbacks and problems.

SUMMARY OF THE INVENTION

The present invention provides a transportable freight container including a generally rectangular enclosure defined by longitudinally extending sidewalls, endwalls, a roof and a floor. The enclosure is ventilated by natural convection through at least one lower side vent comprising a lower plenum chamber for distributing air into the container and restricting entry of moisture in the form of rain, sleet or snow into the container.

In one application, the container comprises a rail freight car including at least one lower side vent including a plenum chamber with a screened opening for distributing air into the rail freight car for ventilation. At least one upper top vent is provided, including a plenum chamber with a screened opening for facilitating the entry and distribution of air via natural convection throughout the rail freight car for ventilation. The upper top vent or vents may be formed in the sidewall of the enclosure or in the roof of the enclosure depending upon the structure of the container and the particular application. The use of one or more upper top vents enhances circulation of air by natural convection.

The invention also incorporates sidewall spacers extending from the sidewalls into the enclosure providing a passageway between the sidewalls and cargo positioned inside the container for the circulation of air to ventilate the enclosure and for condensation to drain down the walls. The invention further incorporates endwall spacers extending from the endwalls into the enclosure defining an air circulation passageway between the endwalls and cargo positioned inside the container in order to provide ventilation of the ends of the container and for condensation to drain down the walls.

In one embodiment of the invention, the transportable freight container of the present invention comprises a rail freight car. In another embodiment of the invention, at least one of the lower plenum chambers of the container extends lower than the floor of the enclosure to allow condensate drainage from the enclosure. In yet another embodiment of the invention, a layer of insulating material is provided on the interior surface of the roof of the container to inhibit condensation of moisture.

The sidewall spacers of the container of the present invention may, depending upon the application, comprise longitudinally extending rub rails. Likewise, in one embodiment, the endwall spacers may comprise vertically extending rub rails. The freight container of the present invention is particularly adapted to the transport of baled material, such as pulp, which is typically shipped or transported in bales of approximately one cubic yard.

DETAILED DESCRIPTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
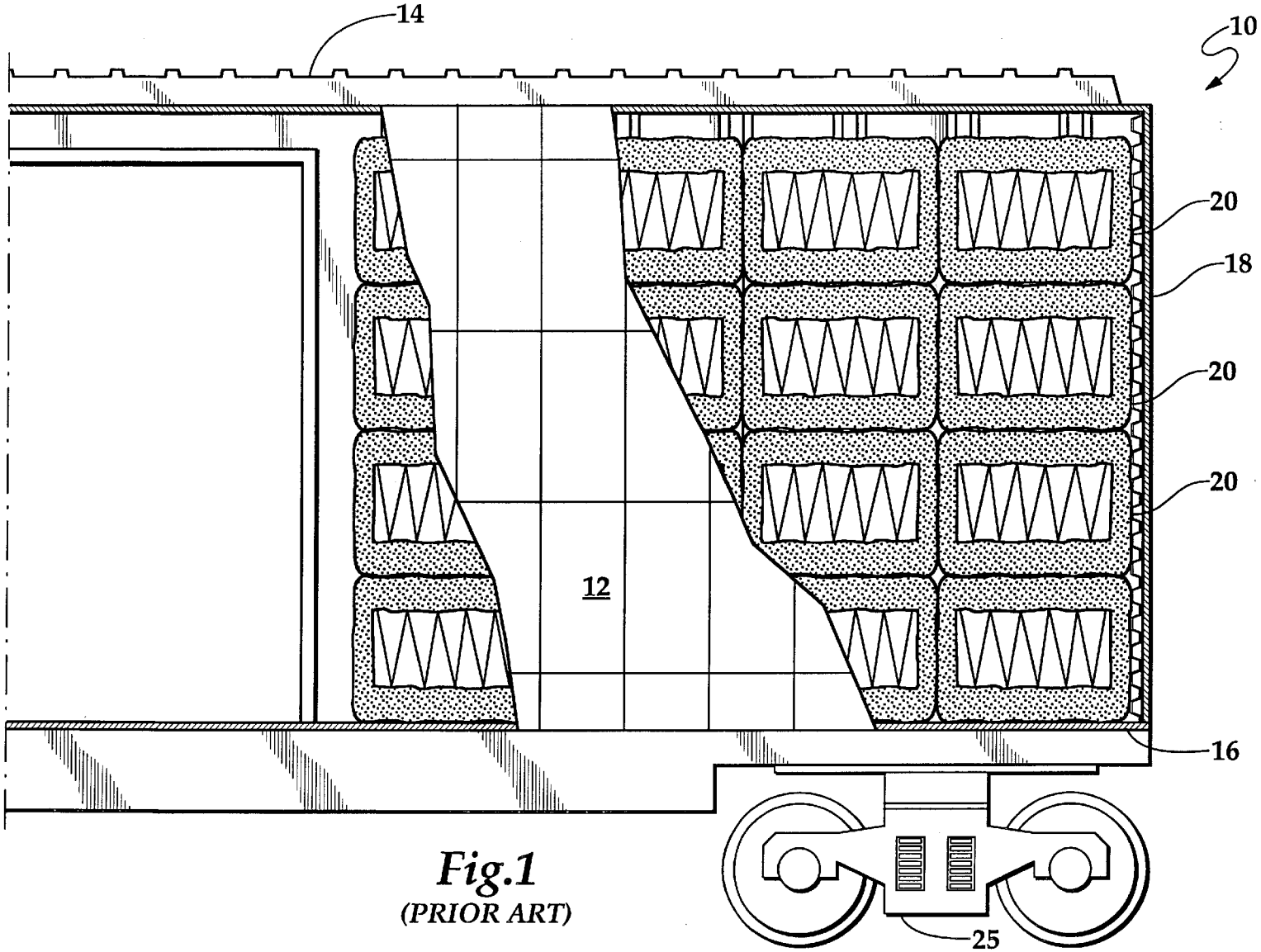
Fig.1 (PRIOR ART)
FIG. 1 is a partial sectional side view of a conventional, prior art freight container.

Referring now to FIG. 1, an illustration of a conventional railcar freight container 10 is presented. The container includes sidewalls 12, roof 14, floor 16 and endwalls 18. Stacked within the container are bales of product 20, such as pulp, paper or similar commodities suitable for binding into bales or bundles for shipment. The railcar freight container is supported on each end by a pair of trucks 25, for transportation over railroad tracks.

Figure 2:
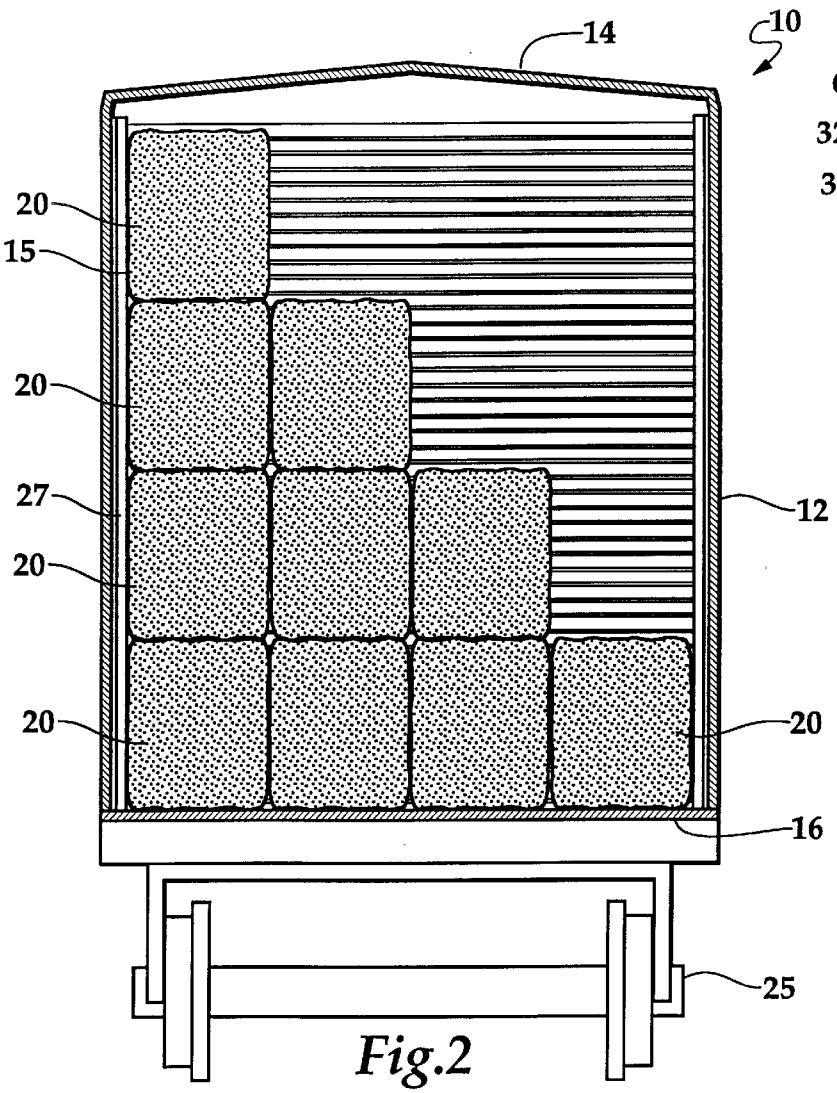
Fig.2 (PRIOR ART)
FIG. 2 is a sectional end view of a conventional, prior art freight container.

Turning now to FIGS. 1 and 2 together, the conventional manner of loading a railcar freight container with bundles or bales of product is to stack the bales in rows. In this configuration, at least one surface 27 of a bale 20 positioned adjacent to sidewall 12 is placed in direct contact with the sidewall 12 of the railcar freight container 10. Similarly, at the ends of the railcar 10, the bales 20 are typically abutted against the endwalls 18.

In the conventional configuration as illustrated in FIGS. 1 and 2, there is no allowance provided for ventilation of the interior areas of the railcar container. However, during the transport of goods such as pulp and produce, ventilation of the interior of the container is necessary to reduce the risk of spoilage due to mold, mildew and moisture induced degradation of the product. Water entrained in the product or product bales tends to migrate via evaporation out of the product. Condensation of this moisture on or adjacent to the product tends to increase the probability of spoilage. Furthermore, having surfaces of the bales 20 in direct contact with the sidewalls 12 or endwalls 18 of the railcar freight container 10 may result in the product bales or bundles 20 sticking to the interior surfaces of the container. This, in turn, can result in difficulties in unloading the product, damage to the product and corrosion of the interior walls of the container 10. This effect is exacerbated by the condensation of moisture evaporating from the product, especially in the case of products such as bales of pulp.

Figure 4:
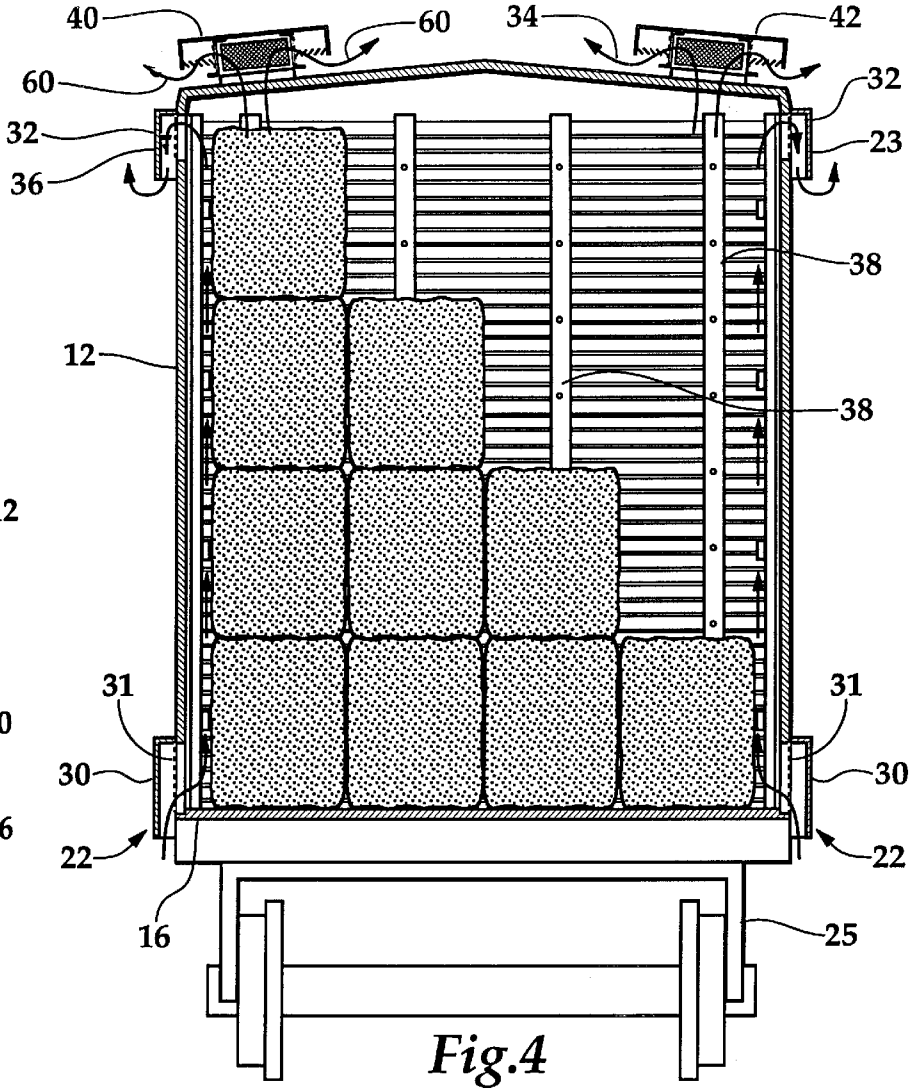
FIG. 4 is a sectional end view of one embodiment of the freight container of the present invention.
Figure 3:
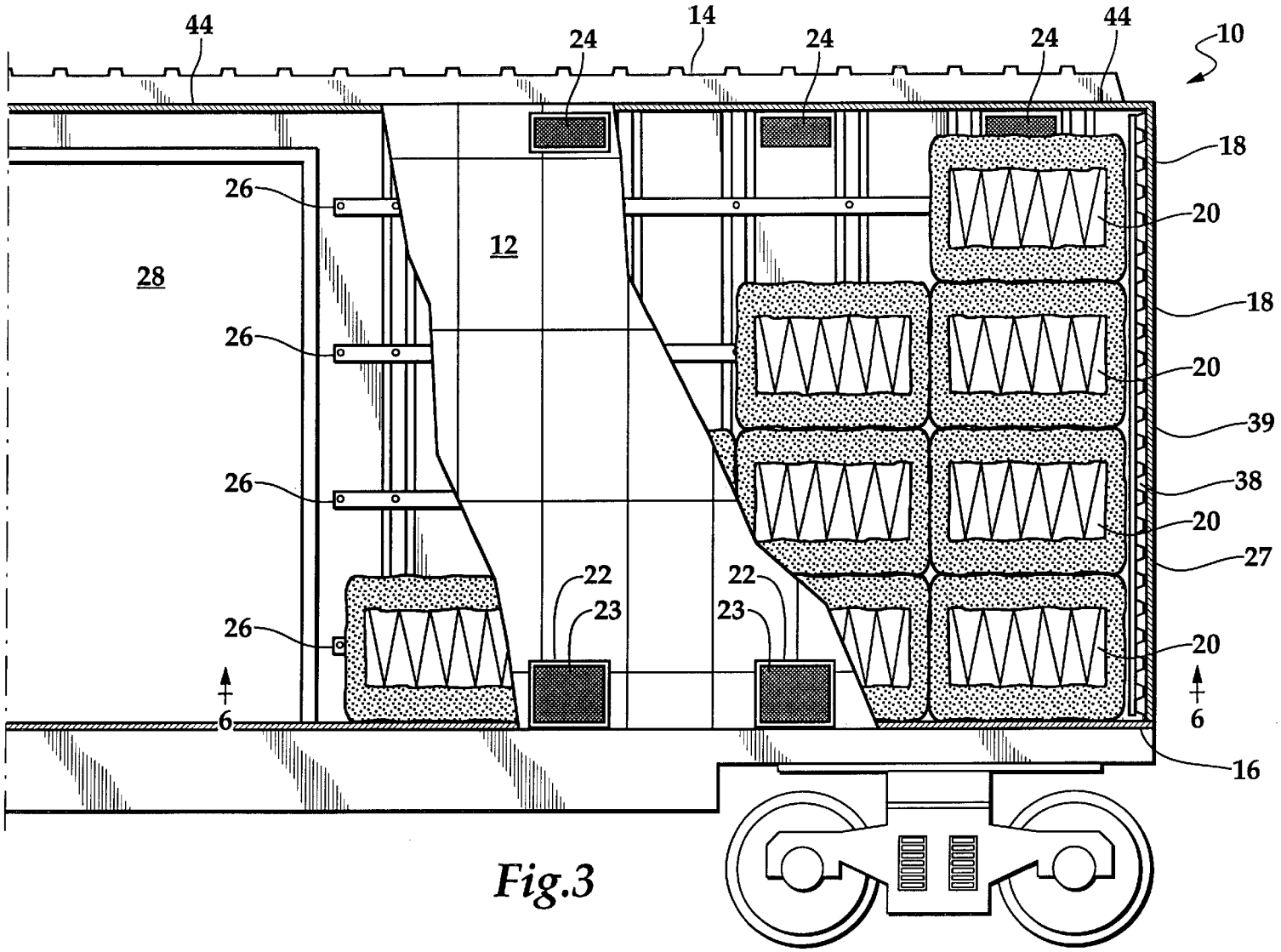
FIG. 3 is a partial sectional side view of one embodiment of the freight container of the present invention.

Referring now to FIGS. 3 and 4, a mobile enclosure embodying the freight container 10 of the present invention is illustrated. The freight container 10 is provided with lower side vents 22 to allow air to enter the car for the purpose of ventilating the interior of the car. Lower side vents 22 are formed by making a cutout in the sidewall of the car, for example, a square hole approximately eighteen inches by eighteen inches (18"×18"). The exact size of the cutout will depend upon the particular application, including such factors as the cargo to be transported, along with the size and structure of the particular freight container 10. The lower side vents may also be larger or smaller, depending upon the number and positioning of the vents. In one application, the freight container 10 is a rail freight boxcar equipped with eight (8) lower side vents 22, four on each side of the side of the container. In this configuration, two side vents are positioned in sidewall 12 on each side of cargo door 28, as best illustrated in FIG. 3.

After the cutouts for the lower side vents have been formed in the sidewalls 12 of freight container 10, the cutouts are covered with a screen 23, such as expanded metal to minimize the ingress of foreign material, birds and other pests. After the cutouts have been fitted with screens, a cover 30 is fastened over the screened cutout to form a plenum chamber 31 between the screened cutout and the cover 30. Cover 32 provides for circulation of air through the freight container while minimizing the entry of moisture in the form of rain, snow or sleet into the freight container 10. In one embodiment of the invention, the cutout and the plenum chamber extend sightly below, for example a quarter inch (¼"), the level of the floor 16 of the container 10 in order to facilitate drainage of condensation from the car. The cover 30 may be secured to the sidewall 12 of the freight container by any suitable method, e.g., welding, bolting or by means of clips. Although, as illustrated, the cover 30 is positioned over the screen 23 on the exterior of the freight container 10, it is contemplated that the cover 30 could be positioned over the screen 23 on the interior of the freight container 10 if desired.

In order to allow air entering the freight container 10 through lower side vents 22 to circulate, it is necessary to provide a path through which air can flow. Since bundles, boxes or bales of product tend to shift during loading and transport operations until restrained by a portion of the enclosure, in order to insure that product does not move into an abutting relationship with sidewalls 12, thereby blocking any vertical air passageway, it is necessary to provide means for restraining the cargo away from the interior surface of sidewalls 12. In order to insure that a vertical circulation path remains clear, the freight container 10 is equipped with rub rails or sidewall spacers 26 extending longitudinally along the interior of sidewalls 12 as illustrated in FIGS. 3–6.

Figure 6:
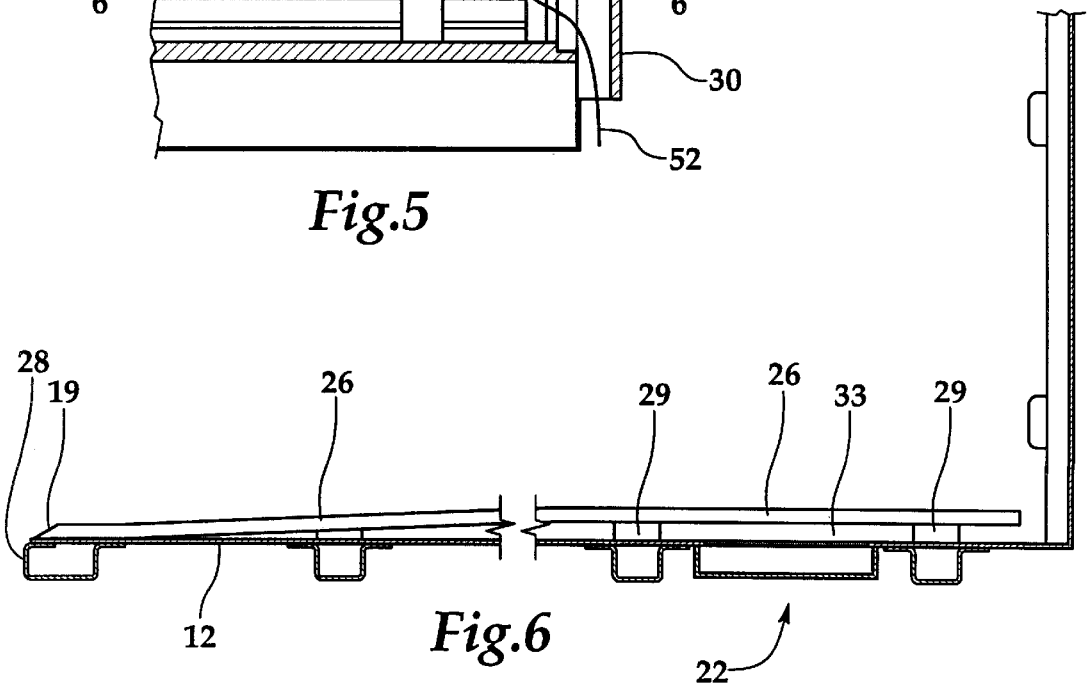
FIG. 6 is a partial cross sectional view along line 6'—6' of FIG. 3 further illustrating the features of one embodiment of the freight container of the present invention.

The rub rails or sidewall spacers 26 may be formed from any inert material, e.g., plastic or stainless steel, depending upon the particular application. The rub rails or sidewall spacers 26 should, of course, be constructed from materials sufficient to withstand incidental forces resulting from load shifting during transit or bumping during the loading or unloading operation. For example, the rub rails or sidewall spacers 26 may be made from an Ultra High Molecular Weight ("UHMW") plastic extruded channel, or some other geometry depending upon the particular application. The rub rails or sidewall spacers 26 are mounted on the interior of sidewalls 12 with brackets 29 to provide a space 33 between side walls 12 and product bundles or bales 20. The rub rails or sidewall spacers 26 may be mounted in a fixed or free floating manner. The distance between the interior of sidewall 12 and the rub rail sidewall or spacer 26 may vary depending upon the particular application; however, the rub rails sidewall 26 are typically mounted to provide a gap of one to two inches between the interior of sidewall 12 and product bundles 20. As best illustrated in FIG. 6, the spacing of the rub rails or sidewall spacers 26 may be tapered away from the side wall 12 of the container freight 10 beginning at the freight container 10 door 28. This configuration facilitates loading the container insofar as the end 19 of the rub rail or sidewall spacer 26 proximate to the container door 28 does not project out, presenting an obstruction that could interfere with cargo loading operations by forklifts.

Depending upon the particular application, the vertical spacing of rub rails or sidewall spacers 26 may vary. In particular, the vertical spacing of the rub rails or sidewall spacers 26 should ideally be less than the dimensions of the bundle, box or bale of product to be transported in order to assure that the product is held away from the sidewalls 12 to provide a passageway allowing air to circulate within the freight container 10. Thus, for example, in an application where three (3') foot square bundles of product are being transported, it may be desirable to position the rub rails or sidewall spacers at two foot six inch (2'6") vertical intervals.

As illustrated, four (4) rub rails or sidewall spacers 26 are shown extending longitudinally along the interior of sidewalls 12 of the freight container 10. However, as will be appreciated by those skilled in the art, a greater or lesser number of rub rails or sidewall spacers 26 may be used, depending upon the specific application and, in particular, in consideration of the dimensions of the bales, bundles or boxes to be transported.

Figure 5:
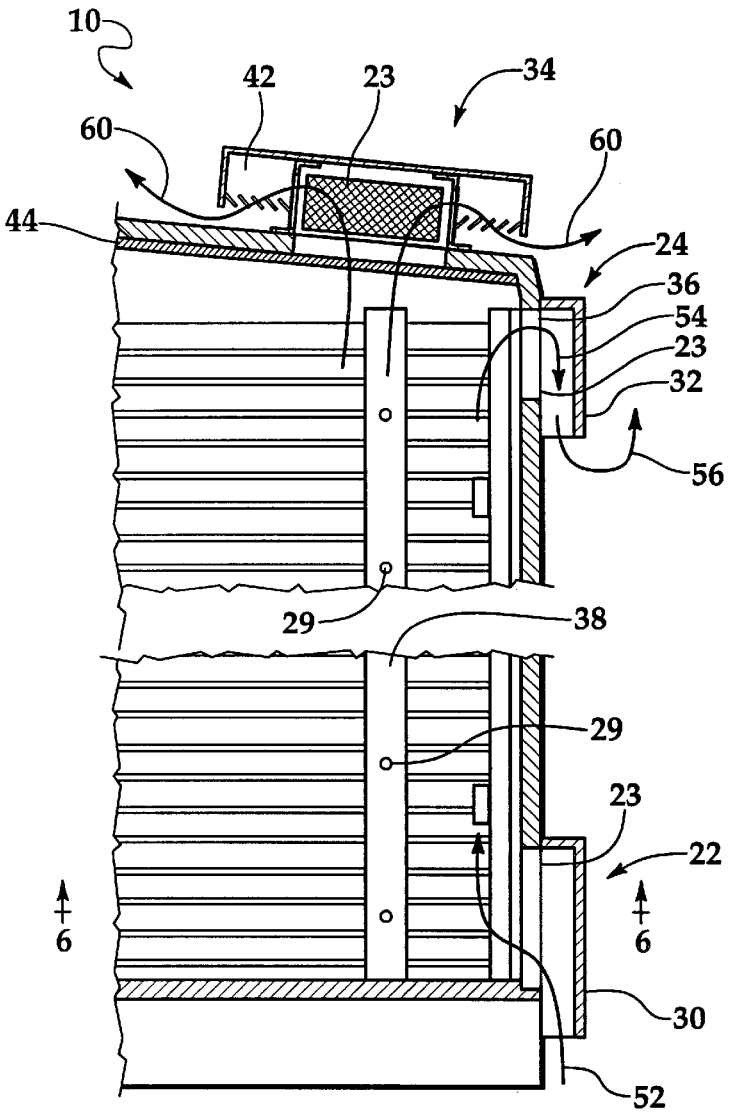
FIG. 5 is a partial cross sectional view of one embodiment of the freight container of the present invention.

Turning now to FIGS. 4, 5 and 6, the ventilation system of the present invention is illustrated in greater detail. To allow air to circulate through the freight container 10, top side vents 24 are provided. Roof vents 34 may also be provided, either in combination with top side vents 24 or as an alternative to top side vents 24. Air entering the railcar via lower side vents 22 circulates through the passageway defined by rub rails 26 and circulates by natural convection along the sidewalls of the freight container 10, exiting the freight container 10 through top side vents 24 and/or roof vents 34. The ventilation passageways are illustrated by arrows 52, 54, 56, and 60 as shown in FIGS. 4, 5 and 6.

Top side vents 24 are formed by making a cutout in the sidewall 12 of the car, for example, a rectangular hole approximately eight inches by twelve inches (8"×12"). The exact size of the cutout will depend upon the particular application, including such factors as the cargo to be transported, along with the size and structure of the particular freight container. The top side vents 24 may also be larger or smaller, depending upon the number and positioning of the vents. In one application, the freight container 10 is a rail freight boxcar equipped with twelve top side vents 24, six on each side of the side of the freight container 10. In this configuration, three top side vents 24 are positioned in a generally symmetrical pattern in sidewall 12 on each side of cargo door 28, as best illustrated in FIG. 3.

After the cutouts for the top side vents 24 have been formed in the sidewalls 12 of freight container 10, the cutouts are covered with a screen 23, such as expanded metal to minimize the ingress of foreign material, birds and other pests. After the cutouts have been fitted with screens, a cover 32 is fastened over the screened cutout to form a plenum chamber 36 between the screened cutout and the cover 32. The cover 32 may be secured to the sidewall 12 of the freight container 10 by any suitable method, e.g., welding, bolting or by means of clips. Although, as illustrated,the cover 32 is positioned over the screen 23 on the exterior of the freight container 10, it is contemplated that the cover 32 could be positioned over the screen 23 on the interior of the freight container 10 if desired. The cover 32 facilitates the circulation of air through the freight container 10 while minimizing the entry of moisture in the form of rain, snow or sleet into the freight container 10.

In applications where it is desirable to utilize roof vents 34, the vents may be provided in the same general fashion as in the case of the lower side vents 22 and upper top side vents 24. Roof vents 34 are formed by making a cutout in the roof of the freight container 10. For the purpose of the disclosure, upper side vents 24 and roof vents 34 are collectively referred to as "upper vents". The size of the cutout will depend upon the particular application, including such factors as the particular cargo to be transported and the design of the particular freight container 10. The cutouts are covered with a screen 23, such as expanded metal to minimize the ingress of foreign material, birds and other pests. After the cutouts have been fitted with screens, a cover 40 is fastened over the screened cutout to form a chamber 42 between the screened cutout and the cover 40. The cover 40 may be secured to the roof 14 of the freight container 10 by any suitable method, e.g., welding, bolting or by means of clips. Although, as illustrated, the cover 40 is positioned over the screen 23 on the exterior of the freight container 10, it is contemplated that the configuration of the venting system could be altered such that the cover 40 could be positioned over the screen 23 on the interior of the freight container 10 if desired.

In order to provide for air circulation around cargo at the ends of the container freight 10, the present invention provides means for restraining bundles, boxes or bales of product away from the endwalls 18 of the freight container 10. As previously noted, bundles, boxes and bales of cargo tend to shift during loading and transport operations. Therefore, in order to provide a path through which air can circulate, it is necessary to prevent the cargo from abutting the walls of the freight container 10. To insure that a circulation path remains clear, the freight container 10 is equipped with rub rails or endwall spacers 38 extending vertically along the interior of endwalls 18 of freight container 10, as best illustrated in FIGS. 4 and 5. As in the case of rub rails 26, rub rails or endwall spacers 38 may be formed from any conventional material, e.g., metal, plastic or wood, depending upon the particular application. Also, as previously noted, rub rails 38 should be constructed from materials sufficient to withstand incidental forces resulting from load shifting during transit or bumping during the loading or unloading operation such as a formed steel rail. As illustrated, the rub rails or endwall spacers 38 are mounted on the interior of endwalls 18 with brackets 29 to provide a space 39 between the endwalls 18 and the cargo through which air can circulate. The rub rails or endwall spacers 38 may be mounted in a fixed or free floating manner. The rub rails or endwall spacers 38 are typically mounted to provide a gap or space 39 of one to two inches between the endwall 18 and the cargo, however the spacing may vary depending upon the particular application. The horizontal spacing of the rub rails or endwall spacers 38 should ideally be less than the dimensions of the bundle, box or bale of product to be transported in order to assure that the product is held away from the endwalls 18 to provide a passageway allowing air to circulate within the freight container 10. Thus, for example, in an application where three (3') foot square bundles of product are being transported, it may be desirable to position the rub rails or endwall spacers 38 at two foot six inch (2'6") vertical intervals.

As illustrated, four (4) rub rails or end wall spacers 38 extend vertically along the interior of endwalls 18 of the freight container 10. However, as will be appreciated by those skilled in the art, a greater or lesser number of rub rails or endwall spacers 38 may be used, depending upon the specific application and, in particular, in consideration of the dimensions of the bales, bundles or boxes to be transported.

In another embodiment of the invention, the freight container 10 of the present invention is provided with a layer of insulating material 44 applied to the interior of roof 14. Condensation of moisture on the roof 14 of a freight container 10 such as shown in FIGS. 1 and 2 almost invariably results in the condensed water dripping onto the cargo in the freight container 10. In one application of the invention, a layer of insulating material 44 is applied to the interior surface of the roof 14 of the freight container 10 to inhibit condensation of moisture, thereby minimizing the chance of spoilage due to mildew, mold or water impregnation into the cargo. In one embodiment, the material utilized to form the insulating layer 44 is Daubert Insulmat 279 applied in a one-eight (⅛") layer to the interior surface of the roof 14 of the freight container 10. In this embodiment, the freight container 10 of the present invention is particularly adapted to the transport of baled material, such as pulp, which is typically shipped or transported in bales of approximately one cubic yard.

The following Examples are presented to further illustrate the advantages of the invention:

EXAMPLE I

Bales of pulp were loaded into a rail car incorporating the features of the invention. The rail car was in transit for approximately one week and was subsequently unloaded. The pulp bales were dry to the touch and no bleeding of bale marks was observed upon unloading the cargo.

EXAMPLE II

Bales of pulp were loaded into a rail car incorporating the features of the invention. The rail car was in transit for approximately two days and was subsequently unloaded. The pulp bales were dry to the touch on the side and top of the bales. Bales marks bled in spots onto the container in the doorway; however, the bleed marks were not as extensive as in the case of conventional cars.

The present invention provides numerous advantages over the prior art. For example, the rub rails or spacers 26, 38 are fixed in position, thereby requiring no manual adjustment. The ventilated container of the present invention relies upon natural convection to ventilate the container via the lower side vents and upper top vents. Consequently, there is no requirement for the motors, fans, power supplies, etc. associated with a forced air ventilation system. The ventilated container of the present invention also requires no operator adjustment or attention.

While the invention has been described with a reference to illustrative embodiments, this description is not intended to be construed in a limiting sense. Various modifications and combinations of the illustrative embodiments as well as other embodiments of the invention will be apparent to persons skilled in the art upon reference to the description. For example, while the apparatus of the present invention is illustrated and described in connection with railroad freight cars, it should be understood by one skilled in the art that the invention is adaptable to other applications such as truck trailers and similar containers. It is, therefore, intended that the appended claims encompass any such modifications or embodiments.

We claim:

1. A container for transporting freight comprising:

a generally rectangular enclosure defined by longitudinally extending sidewalls, end walls, a roof and a floor;

at least one lower vent formed in each sidewall, the lower vent further comprising a lower plenum chamber, the lower plenum chamber restricting entry of moisture into the enclosure;

at least one upper vent, the upper vent further comprising an upper plenum chamber, the upper plenum chamber restricting the entry of moisture into the enclosure; and longitudinal rub rails extending from the sidewalls into the enclosure, the rub rails defining a passageway between the sidewalls and the freight positioned inside the enclosure to provide ventilation of the enclosure and drainage of condensation.

2. The container of claim 1 wherein the container comprises a rail freight car.

3. The container of claim 1 wherein the lower plenum chamber extends lower than the floor of the enclosure to allow drainage from the enclosure.

4. The container of claim 1 further comprising a layer of insulating material on the interior surface of the roof of the container.

5. The container of claim 1 wherein the rub rails are stainless steel.

6. The container of claim 1 wherein the rub rails are plastic.

7. The container of claim 1 wherein the rub rails are wood.

8. The container of claim 1 wherein at least one upper side vent is in the end wall.

9. The container of claim 1 wherein at least one upper vent is in the sidewall.

10. The container of claim 1 wherein at least one upper vent is in the roof.

11. The container of claim 1 wherein at least one upper vent is in the end wall and at least one upper vent is in the roof.

12. The container of claim 1 wherein at least one upper vent is in the sidewall and at least one upper vent is in the roof.

13. A container for transporting freight comprising:

a generally rectangular enclosure defined by longitudinally extending sidewalls, end walls, a roof and a floor;

at least one lower vent formed in each sidewall, the lower vent further comprising a lower plenum chamber, the lower plenum chamber restricting entry of moisture into the enclosure;

at least one upper vent, the upper vent further comprising an upper plenum chamber, the upper plenum chamber restricting the entry of moisture into the enclosure;

sidewall spacers extending from the sidewalls into the enclosure, the sidewall spacers defining a passageway between the sidewalls and the freight positioned inside the enclosure to provide ventilation of the enclosure and drainage of condensation; and vertical rub rails extending from the end walls into the enclosure, the rub rails defining a passageway between the end walls and the freight positioned inside the container.

14. The rail freight car of claim 13 wherein the lower vent extends beneath the floor of the enclosure to allow drainage from the enclosure.

15. The rail freight car of claim 13 further comprising a layer of insulating material on the interior surface of the roof.

16. A container for transporting freight comprising:

a generally rectangular enclosure defined by sidewalls, end walls, a roof and a floor;

at least one lower vent formed in each sidewall, the lower vent further comprising a cover for minimizing the entry of moisture into the enclosure;

at least one upper vent, the upper vent further comprising a cover for minimizing the entry of moisture into the enclosure;

end wall spacers extending from the end walls into the enclosure, the end wall spacers defining a passageway between the end walls and the freight positioned inside the enclosure to provide ventilation of the enclosure and drainage of condensation; and longitudinal rub rails extending from the sidewalls into the enclosure, the rub rails defining a passageway between the sidewalls and the freight positioned inside the enclosure, the rub rails providing a passageway for the flow of air for ventilation of the enclosure and drainage of condensation.

17. The container of claim 16 wherein the end-wall spacers comprise vertically extending rub rails.

18. The container of claim 16 wherein at least one of the lower vent further comprises a plenum chamber including a screened opening for distributing air into the container for ventilation.

19. The container of claim 16 wherein at least one of the upper vents further comprises a plenum chamber including a screened opening for facilitating the distribution of air into the container for ventilation.

20. The container of claim 16 wherein at least one upper vent is formed in the end wall and at least one upper vent is formed in the roof.

21. The container of claim 16 wherein at least one upper side vent is formed in the sidewall and at least one upper vent is formed in the roof.

22. A container for transporting freight comprising:

a generally rectangular enclosure defined by sidewalls, end walls, a roof and a floor;

at least one lower vent formed in each sidewall, the lower vent further comprising a cover for minimizing the entry of moisture into the enclosure;

at least one upper vent, the upper vent further comprising a cover for minimizing the entry of moisture into the enclosure; and vertical rub rails extending from the end walls into the enclosure, the rub rails defining a passageway between the end walls and the freight positioned inside the enclosure to provide ventilation of the enclosure and drainage of condensation.

23. The container of claim 22 wherein at least one of the lower vents further comprises a plenum chamber including a screened opening for distributing air into the container for ventilation.

24. The container of claim 22 wherein at least one of the upper vents further comprises a plenum chamber including a screened opening for facilitating the distribution of air into the container for ventilation.

25. The container of claim 22 wherein the container comprises a rail freight car.

26. The container of claim 22 wherein at least one of the lower plenum chambers extends lower than the floor of the enclosure to allow drainage from the enclosure.

27. The container of claim 22 further comprising a layer of insulating material on the interior surface of the roof of the container.

28. The container of claim 22 wherein at least one upper side vent is in the end wall and at least one upper side vent is in the roof.

29. The container of claim 22 wherein at least one upper side vent is in the sidewall and at least one upper side vent is in the roof.

30. A container for transporting freight comprising:

a generally rectangular enclosure defined by longitudinally extending sidewalls, end walls, a roof and a floor;

at least one lower vent formed in each sidewall, the lower vent further comprising a lower plenum chamber, the lower plenum chamber restricting entry of moisture into the enclosure;

at least one upper top vent formed in one of the end walls, the upper vent further comprising an upper plenum chamber, the upper plenum chamber restricting the entry of moisture into the enclosure; and sidewall spacers extending from the sidewalls into the enclosure, the sidewall spacers defining a passageway between the sidewalls and the freight positioned inside the enclosure to provide ventilation of the enclosure and drainage of condensation.

31. A container for transporting freight comprising:

a generally rectangular enclosure defined by longitudinally extending sidewalls, end walls, a roof and a floor;

at least one lower vent formed in each sidewall, the lower vent further comprising a lower plenum chamber, the lower plenum chamber restricting entry of moisture into the enclosure;

at least one upper top vent formed in each sidewall, the upper vent further comprising an upper plenum chamber, the upper plenum chamber restricting the entry of moisture into the enclosure; and sidewall spacers extending from the sidewalls into the enclosure, the sidewall spacers defining a passageway between the sidewalls and the freight positioned inside the enclosure to provide ventilation of the enclosure and drainage of condensation.

32. The container of claim 31 wherein the sidewall spacers are stainless steel.

33. The container of claim 31 wherein the sidewall spacers are plastic.

34. The container of claim 31 wherein the sidewall spacers are wood.

35. The container of claim 31 wherein the container comprises a rail freight car.

36. A container for transporting freight comprising:

at least one upper side vent is formed in the roof generally rectangular enclosure defined by longitudinally extending sidewalls, end walls, a roof and a floor;

at least one lower vent formed in each sidewall, the lower vent further comprising a lower plenum chamber, the lower plenum chamber restricting entry of moisture into the enclosure;

at least one upper top vent formed in the roof, the upper vent further comprising an upper plenum chamber, the upper plenum chamber restricting the entry of moisture into the enclosure; and sidewall spacers extending from the sidewalls into the enclosure, the sidewall spacers defining a passageway between the sidewalls and the freight positioned inside the enclosure to provide ventilation of the enclosure and drainage of condensation.

37. A container for transporting freight comprising:

a generally rectangular enclosure defined by sidewalls, end walls, a roof and a floor;

at least one lower vent formed in each sidewall, the lower vent further comprising a cover for minimizing the entry of moisture into the enclosure;

at least one upper vent formed in one of the end walls, the upper vent further comprising a cover for minimizing the entry of moisture into the enclosure; and end wall spacers extending from the end walls into the enclosure, the end wall spacers defining a passageway between the end walls and the freight positioned inside the enclosure to provide ventilation of the enclosure and drainage of condensation.

38. A container for transporting freight comprising:

a generally rectangular enclosure defined by sidewalls, end walls, a roof and a floor;

at least one lower vent formed in each sidewall, the lower vent further comprising a cover for minimizing the entry of moisture into the enclosure;

at least one upper vent formed in each sidewall, the upper vent further comprising a cover for minimizing the entry of moisture into the enclosure; and end wall spacers extending from the end walls into the enclosure, the end wall spacers defining a passageway between the end walls and the freight positioned inside the enclosure to provide ventilation of the enclosure and drainage of condensation.

39. The container of claim 38 wherein the endwall spacers are stainless steel.

40. The container of claim wherein the endwall spacers are plastic.

41. The container of claim 1 wherein the endwall spacers are wood.

42. The container of claim 38 wherein the container comprises a rail freight car.

43. A container for transporting freight comprising:

a generally rectangular enclosure defined by sidewalls, end walls, a roof and a floor;

at least one lower vent formed in each sidewall, the lower vent further comprising a cover for minimizing the entry of moisture into the enclosure;

at least one upper vent formed in the roof, the upper vent further comprising a cover for minimizing the entry of moisture into the enclosure; and end wall spacers extending from the end walls into the enclosure, the end wall spacers defining a passageway between the end walls and the freight positioned inside the enclosure to provide ventilation of the enclosure and drainage of condensation.

* * * * *